US006981793B2

(12) United States Patent
Behr et al.

(10) Patent No.: US 6,981,793 B2
(45) Date of Patent: Jan. 3, 2006

(54) HEADLAMP BULB

(75) Inventors: Gerhard Behr, Altheim (DE); Uwe Kantim, Niederstotzingen (DE); Peter Helbig, Sontheim (DE)

(73) Assignee: Patent-Treuhand-Gesellschaft für elektrische Glühlampen mbH, Munich (DE)

( * ) Notice: Subject to any disclaimer, the term of this patent is extended or adjusted under 35 U.S.C. 154(b) by 53 days.

(21) Appl. No.: 10/490,307

(22) PCT Filed: Sep. 25, 2002

(86) PCT No.: PCT/DE02/03619

§ 371 (c)(1),
(2), (4) Date: Mar. 19, 2004

(87) PCT Pub. No.: WO03/030213

PCT Pub. Date: Apr. 10, 2003

(65) Prior Publication Data

US 2005/0002187 A1 Jan. 6, 2005

(30) Foreign Application Priority Data

Sep. 28, 2001 (DE) ..... 101 48 114

(51) Int. Cl.
*H01R 33/00* (2006.01)

(52) U.S. Cl. ..... 362/651; 362/457; 362/548; 439/57

(58) Field of Classification Search ..... 362/457, 362/498, 507, 538, 540, 651, 548; 439/57, 439/547

See application file for complete search history.

(56) References Cited

U.S. PATENT DOCUMENTS

| | | | | |
|---|---|---|---|---|
| 1,527,617 | A * | 2/1925 | Tuska | 74/553 |
| 4,682,274 | A * | 7/1987 | Freudenreich et al. | 362/519 |
| 4,812,703 | A * | 3/1989 | Kanematsu et al. | 313/318.07 |
| 5,361,191 | A * | 11/1994 | Matsuzaki et al. | 362/549 |
| 5,957,569 | A | 9/1999 | Helbig et al. | 362/263 |

FOREIGN PATENT DOCUMENTS

| | | |
|---|---|---|
| DE | 199 51 203 | 4/2001 |

* cited by examiner

*Primary Examiner*—Alan Cariaso
*Assistant Examiner*—Adam C. Rehm
(74) *Attorney, Agent, or Firm*—William E. Meyer

(57) ABSTRACT

The invention relates to a headlight lamp whose base (9) has a plastic ring (13) in which there are embedded at least two contact lugs (13*a*–13*c*) designed as electric terminals. The contact lugs (13*a*–13*c*) are arranged in a common plane perpendicular to the ring axis (13) and in each case project in the radial direction from the plastic ring (13).

3 Claims, 3 Drawing Sheets

HEADLAMP BULB

The invention relates to a headlight lamp in accordance with the preamble of patent claim 1.

I. PRIOR ART

Such a headlight lamp is disclosed, for example, in German Laid-open Patent Application DE 199 51 203 A1. This patent application describes a headlight lamp having a lamp vessel, an incandescent filament arranged therein, a lamp base in which the lamp vessel is anchored, and two contact lugs which extend in the longitudinal direction of the lamp and serve to contact the supply leads, projecting from the lamp vessel, for the incandescent filament. The lamp base further has a flange with three lugs which are of resilient design and for their part cooperate with three reference noses in order to fix the lamp in a headlight in the manner of a bayonet lock. The electric connection of the headlight lamp to the power supply unit is performed independently of the abovenamed bayonet lock with the aid of a plug which is pushed onto the contact lugs after the lamp is mounted in the headlight.

II. SUMMARY OF THE INVENTION

It is the object of the invention to provide a headlight lamp with improved electric terminals.

This object is achieved according to the invention by means of the features of patent claim 1. Particularly advantageous designs of the invention are described in the dependent claims.

The headlight lamp according to the invention has at least one lamp vessel, in which at least one luminous means is enclosed, at least two supply leads, projecting from the at least one lamp vessel, for supplying power to the at least one luminous means, a lamp base which has a metallic base part, in which the at least one lamp vessel is anchored, and which has the means for forming a bayonet lock with a headlight, and at least two electric terminals, which are designed as contact lugs and are connected to the supply leads, the lamp base having a plastic ring which is connected to the metallic base part and in which the at least two contact lugs are embedded, and the contact lugs being arranged in a common plane perpendicular to the ring axis, and projecting in each case in the radial direction from the plastic ring.

The above described, inventive configuration of the lamp base, and the arrangement of the contact lugs render it possible also to make electric contact with the lamp in the headlight simultaneously with the locking of the bayonet lock between the lamp and the headlight. In order to lock the bayonet lock, the lamp is rotated about its longitudinal axis by approximately a quarter turn, as a result of which the contact lugs projecting radially beyond the plastic ring are also brought simultaneously into contact with the electric holder contacts of the headlight. There is thus no need for any additional plugs in order to connect the contact lugs of the lamp to the electric power supply unit. Moreover, according to the invention the contact lugs of the lamp are arranged in a common plane and embedded in a plastic ring which serves to hold the contact lugs and insulate them electrically. The mounting of the headlight lamp according to the invention is thereby substantially simplified. Owing to the arrangement in the common plane, the contact lugs can be produced from a unipartite stamped sheet-metal part which is embedded in the plastic ring, in order to separate the connecting webs between the contact lugs subsequently in the case of the stamped sheet-metal part fixed in the plastic ring. The plastic ring is advantageously designed as an injection-molded part, in order to implement the embedding of the contact lugs in the contact ring in the simplest possible way. Moreover, the end, averted from the lamp vessel, of the lamp base of the headlight lamp according to the invention is advantageously fitted with a web running along a diameter of the plastic ring. This web is suitable as a grip for inserting the lamp into the headlight, and thereby facilitates the changing of the lamp.

III. DESCRIPTION OF THE PREFERRED EXEMPLARY EMBODIMENTS

The invention is explained in more detail below with the aid of a preferred exemplary embodiment. In the drawing.

Figure 1:
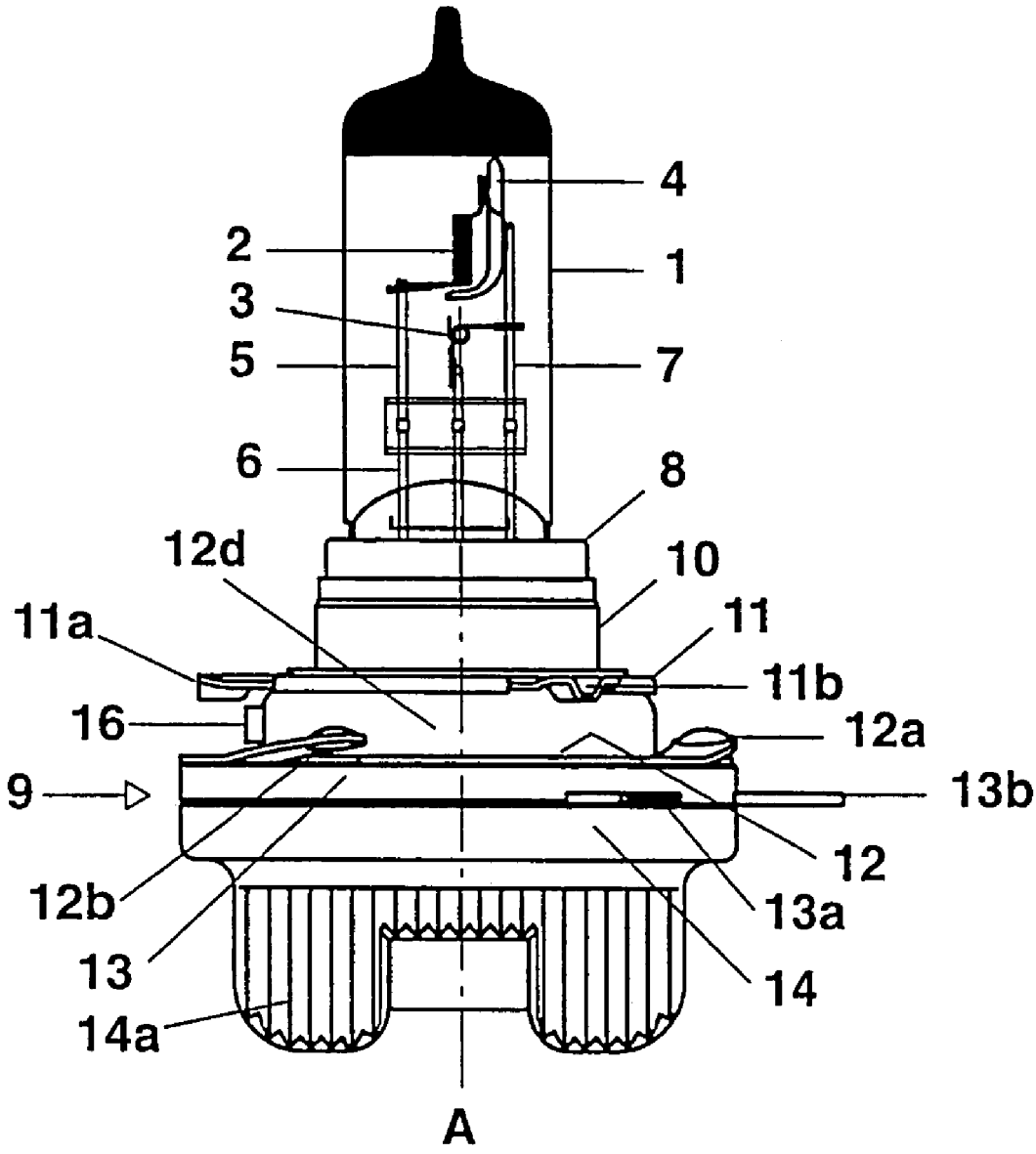
FIG. 1 shows a side view of the first exemplary embodiment of the headlight lamp according to the invention.
Figure 2:
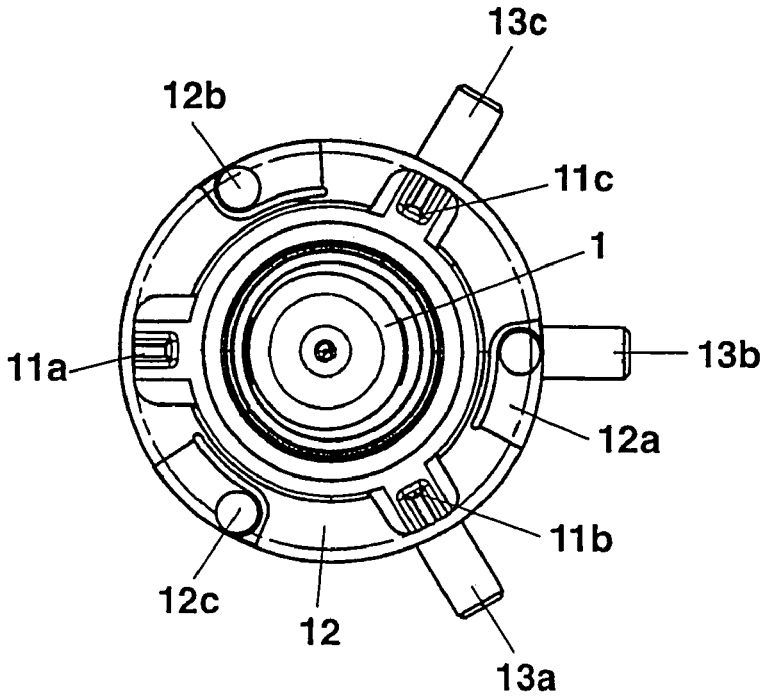
FIG. 2 shows a plan view of the headlight lamp illustrated in FIG. 1
Figure 3:
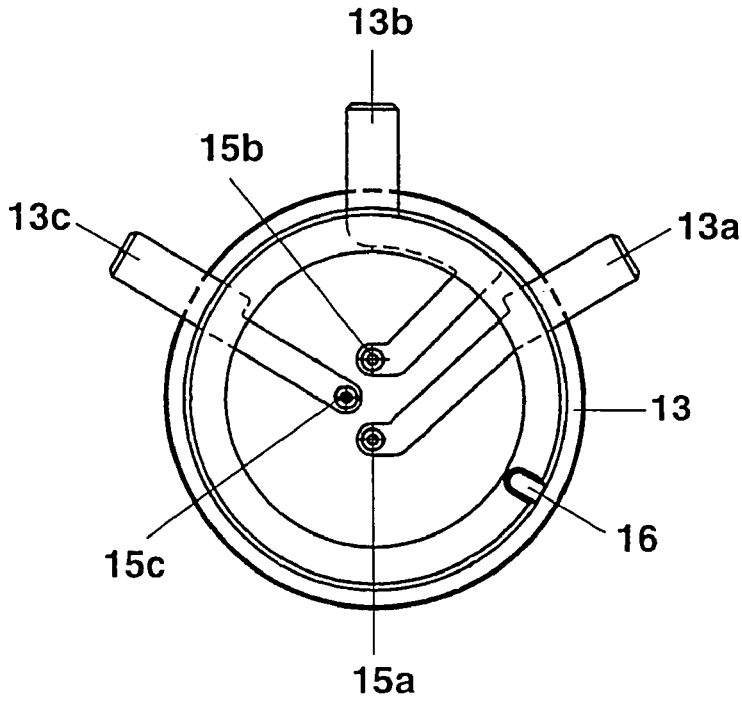
FIG. 3 shows a plan view of the plastic ring with the contact lugs embedded therein.

The preferred exemplary embodiment, illustrated in FIG. 1, of the invention is a two-filament halogen incandescent lamp which is provided for insertion into a motor vehicle headlight. This lamp has a vitreous, essentially cylindrical lamp vessel 1, inside which there are enclosed two incandescent filaments 2, 3 of which one is arranged axially and the other in a transverse fashion to the longitudinal axis A of the lamp or the cylinder axis of the lamp vessel 1. The axially arranged incandescent filament 2 is surrounded in part by an anti-dazzle device 4, likewise arranged inside the lamp vessel 1. Three supply leads 5, 6 and 7, which are led out of the end of the lamp vessel 1 near the base, serve to hold and supply power to the incandescent filaments 2, 3 and the anti-dazzle device 4. The end of the lamp vessel 1 near the base is anchored with a clamping fit in a cutout in a metallic holder 8 which is, for its part, a component of the lamp base 9. The metallic holder 8 is fixed in a metallic adjusting ring 10, which is welded to the reference ring 11. The reference ring 11 has three reference noses 11*a*, 11*b*, 11*c* which extend radially outwards in a fashion substantially perpendicular to the longitudinal axis A and lie in a common plane. These reference noses 11*a*–11*c* are arranged along the circumference of the reference ring 11 at a spacing of 120 degrees. The reference nose 11*a* is wider than the two other reference noses 11*b*, 11*c* in design, in order to define an orientation or installation position of the lamp in the headlight. By means of the conventional adjusting processes, during welding of the metal base parts 8, 10 and 11 the two incandescent filaments 2, 3 are aligned exactly with reference to the three reference nose 11*a*–11*c* and the reference plane defined by them, such that the orientation and installation position of the three reference noses 11*a*–11*c* inside the headlight reflector can also uniquely fix the arrangement of the incandescent filaments 2, 3 in the reflector during insertion of the lamp into a headlight. The reference ring 11 is welded to the metallic, annular base flange 12, whose flange plane is arranged substantially perpendicular to the longitudinal axis A. The base flange 12 has three resiliently designed lugs 12*a*, 12*b*, 12*c* which are arranged uniformly along its annular circumference and develop a spring action in the longitudinal direction A of the lamp. The reference noses 11*a*–11*c* serve as opposing bearings to the resilient lugs. The reference noses 11*a*–11*c* form a bayonet lock together with the base flange 12 and its lugs 12*a*–12*c*, as well as with the opening, correspondingly configured as lamp holder, of the headlight reflector. After the locking of the bayonet lock, the rim of the abovenamed opening of the headlight reflector is arranged with a clamping fit between the reference noses 11*a*–11*c* and the lugs 12*a*–12*c*. Serving to provide lateral support for the lamp at the rim of the headlight reflector opening is a press-on spring 16 which projects outward through a cutout in the annular collar 12*d* of the base flange 12.

Adjoining the base flange 12 is the plastic ring 13, which is designed as an injection-molded part and from which project three metallic contact lugs 13*a*, 13*b*, 13*c*, which are connected in each case in an electrically conducting fashion to a supply lead 5, 6, 7 and form the electric contacts of the headlight lamp. For this purpose, the ends, arranged inside the plastic ring 13, of the contact lugs 13*a*–13*c* are provided in each case with a cutout 15*a*, 15, 15*c* for holding in each case one of the supply leads 5, 6, 7. The ends of the supply leads 5, 6, 7 are welded into the cutouts 15*a*–15*c*, in each case with one of the contact lugs 13*a*–13*c*. The three contact lugs 13*a*–13*c* and, in particular, also their contact surfaces are arranged in a common plane in a fashion perpendicular to the axis of the plastic ring 13, and thus also substantially perpendicular to the longitudinal axis A. They 13*a*–13*c*, extend in the radial direction and project radially from the plastic ring 13. The three contact lugs 13*a*–13*c* are arranged along the circumference of the plastic ring 13 at a spacing of in each case 60 degrees. The plastic ring 13 is provided with a radially running groove 16, serving as positioning aid, in order to fix the position of the contact lugs 13*a*–13*c* with reference to the reference noses 11*a*–11*c* when mounting the base. The middle contact lug 13*b* is arranged diametrically with reference to the wide reference nose 11*a*. The contact lugs 13*a*–13*c* are brought into contact with the corresponding electric holder contacts of the headlight by the rotary movement during locking of the bayonet lock.

The end, averted from the lamp vessel 1, of the lamp base 9 is formed by the grip part 14, which consists of plastic and is fixed by an undetachable plug-in connection on the plastic ring 13 and on the base flange 12. The grip part 14 has a web 14*a* running perpendicular to the longitudinal axis A along a diameter of the plastic ring 13. The web 14*a* can serve as a grip for locking and unlocking the bayonet lock when changing the lamp.

The invention is not limited to the exemplary embodiment explained in more detail above. It can also be applied, for example, to headlight lamps which have only one incandescent filament or one luminous means and, consequently, only two contact lugs.

Figure 4:
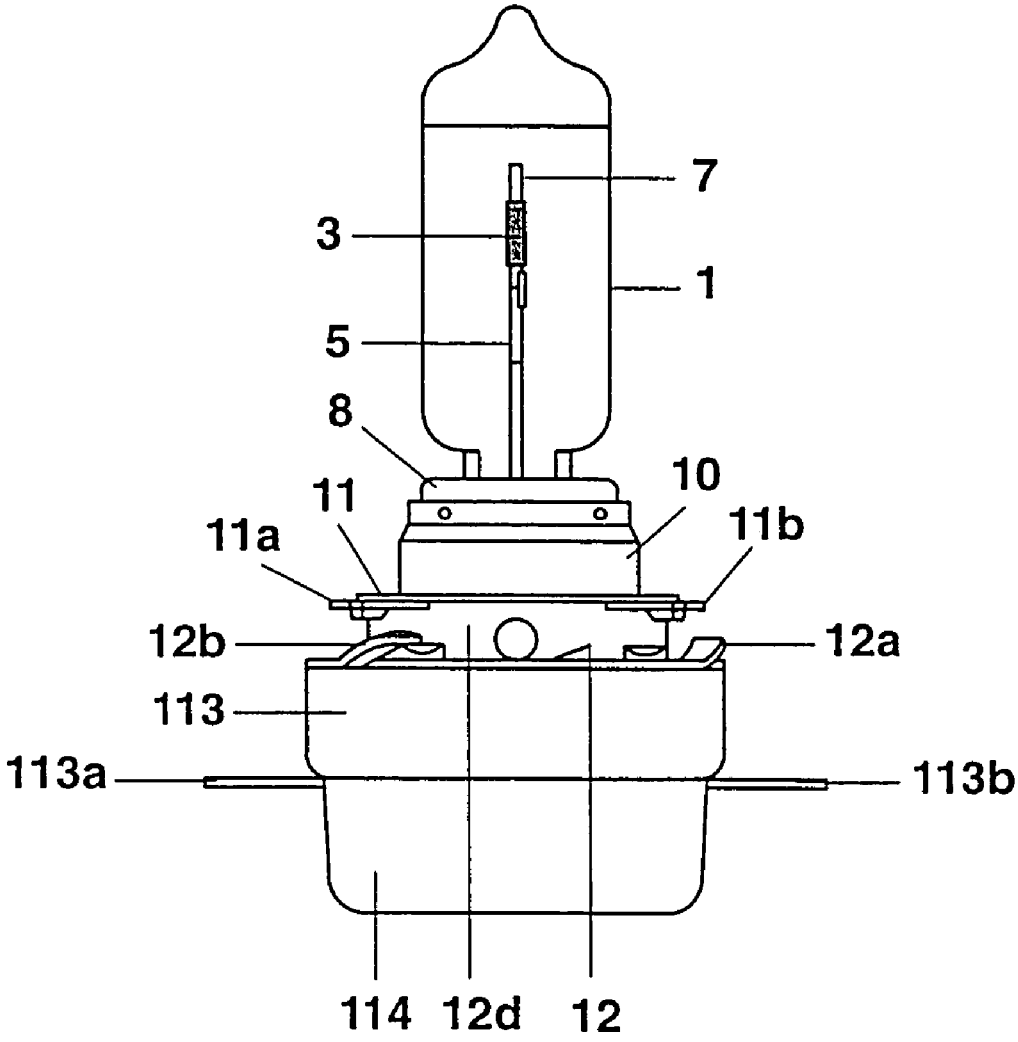
FIG. 4 shows a side view of the second exemplary embodiment of the headlight lamp according to the invention.

A headlight lamp of this type having only one incandescent filament and two contact lugs is schematically represented in FIG. 4. The same reference numerals are used for identical parts as in FIG. 1 of the above described exemplary embodiment. The exemplary embodiment illustrated in FIG. 4 has only two contact lugs 113*a*, 113*b* which are in each case connected to one of the supply leads 5, 7. The contact lugs 113*a*, 113*b* are arranged diametrically with reference to the plastic ring 113, extend in radial direction and project from the plastic ring 113 in radial direction. Their contact surfaces are aligned perpendicular to the axis of the ring or the longitudinal axis of the lamp. The plastic ring is fitted with an integrally formed weblike grip member 114 that extends along a diameter of the plastic ring 113.

What is claimed is:

1. A headlight lamp comprising:

at least one lamp vessel (1) in which at least one luminous means (2, 3) is enclosed, at least two supply leads (5, 6, 7), projecting from the at least one lamp vessel (1), for supplying power to the at least one luminous means (2, 3), a lamp base (9) which has a metallic base part (8, 10, 11, 12), in which the at least one lamp vessel (1) is anchored, and which has a bayonet lock to couple with a headlight housing, and at least two electric terminals which are designed as contact lugs (13*a*, 13*b*, 13*c*) and are connected to the supply leads (5, 6, 7), characterized in that the lamp base (9) has a plastic ring (13) which is connected to the metallic base part (8, 10, 11, 12) and in which the at least two contact lugs (13*a*, 13*b*, 13*c*) are embedded, the contact lugs (13*a*, 13*b*, 13*c*) being arranged in a common plane perpendicular to the ring axis and in each case project in the radial direction from the plastic ring (13).

2. The headlight lamp as claimed in claim 1, characterized in that the plastic ring (13) is designed as an injection-molded part.

3. The headlight lamp as claimed in claim 1, characterized in that the lamp base (9) is fitted at its end averted from the at least one lamp vessel (1) with a web (14*a*) running along a diameter of the plastic ring (13).

* * * * *